US011248841B2

(12) United States Patent
DeWaard

(10) Patent No.: US 11,248,841 B2
(45) Date of Patent: Feb. 15, 2022

(54) COANDĂ-EFFECT VEGETABLE MATERIAL DRYER

(71) Applicant: Dari-Tech, Inc., Lynden, WA (US)

(72) Inventor: David DeWaard, Lynden, WA (US)

(73) Assignee: Dari-Tech, Inc., Lynden, WA (US)

( * ) Notice: Subject to any disclaimer, the term of this patent is extended or adjusted under 35 U.S.C. 154(b) by 98 days.

(21) Appl. No.: 16/718,687

(22) Filed: Dec. 18, 2019

(65) Prior Publication Data

US 2021/0190423 A1 Jun. 24, 2021

(51) Int. Cl.

| | |
|---|---|
| ***F26B 3/00*** | (2006.01) |
| ***F26B 3/04*** | (2006.01) |
| ***F26B 11/02*** | (2006.01) |
| ***F26B 11/04*** | (2006.01) |
| *F26B 25/00* | (2006.01) |
| *F26B 25/16* | (2006.01) |
| *F26B 25/20* | (2006.01) |

(52) U.S. Cl.

CPC ..... *F26B 3/04* (2013.01); *F26B 11/026* (2013.01); *F26B 11/028* (2013.01); *F26B 11/0477* (2013.01); *F26B 11/022* (2013.01); *F26B 25/002* (2013.01); *F26B 25/007* (2013.01); *F26B 25/16* (2013.01); *F26B 25/20* (2013.01); *F26B 2200/02* (2013.01)

(58) Field of Classification Search

CPC .. F26B 3/04; F26B 3/06; F26B 11/026; F26B 11/0477; F26B 11/028; F26B 11/022; F26B 11/04; F26B 11/0481; F26B 25/20; F26B 25/16; F26B 25/002; F26B 25/007; F26B 25/001; F26B 25/04; F26B 25/06; F26B 2200/02

USPC ..... 34/443, 452, 463, 487

See application file for complete search history.

(56) References Cited

U.S. PATENT DOCUMENTS

| | | | | |
|---|---|---|---|---|
| 3,076,269 | A * | 2/1963 | Hagen | F26B 11/028 34/63 |
| 2009/0178296 | A1* | 7/2009 | Duenzinger | F26B 15/18 34/413 |
| 2017/0225111 | A1* | 8/2017 | Jorgenson | F26B 25/007 |
| 2019/0329220 | A1* | 10/2019 | Watabe | F26B 17/106 |

* cited by examiner

*Primary Examiner* — John P McCormack

(74) *Attorney, Agent, or Firm* — Mark Lawrence Lorbiecki

(57) ABSTRACT

A cylindrical drum having a plurality of vanes which extend radially into the drum and extend axially substantially the length of the drum rotates about its axis such that the plurality of vanes convey vegetable material from a lowest point in the interior of the drum to a highest point in the interior of the drum, there, to drop the vegetable matter downward within the interior of the drum. A plenum feeds air through a nozzle opening in a rectangular slot extending in its longest dimension substantially the length of the drum. The plenum and nozzle being housed to form a Coandă-effect nozzle body having a tear-shaped housing. Two Coandă surfaces are situated in opposed relation terminating at the nozzle. The Coandă surfaces to guide air into a combined flow. A hopper plate cooperates with the housing to form a hopper directing vegetable matter to collide with the combined flow.

20 Claims, 12 Drawing Sheets

COANDĂ-EFFECT VEGETABLE MATERIAL DRYER

TECHNICAL FIELD

The present invention relates to the drying of vegetable material in a rotary dryer and, in particular, to the separation and hot-air drying by means of a Coandă-effect vegetable material dryer.

BACKGROUND OF THE INVENTION

The drying of diverse materials such as municipal waste sludge, wood chips, fertilizers and harvested grain, relies upon a heated flow of air blown onto the vegetable matter. The removal of water from a mass of vegetable material by evaporation is often necessary to stabilize the material, either to transport or use the dried material or to preserve it and prevent spoliation due to molds or bacterial deterioration. Most commonly, a rotary dryer is used to present the vegetable material to a stream of air—very like the drying of laundry in a clothes dryer.

Rotary dryers use a tumbling action in combination with a flow of drying air in order to efficiently remove moisture from the vegetable material. Most often, rotary dryers are of the direct configuration, meaning that the drying air is brought into direct contact with the vegetable material.

Rotary dryers comprise a rotating drum, into which the material is fed in combination with a flow of heated drying air. Rotary drums include flighting or vanes; these vanes are the primary material handling mechanism in the rotary drum, conveying the material from the bottom of the rotary drums carrying the vegetable material to near the top where gravity draws the material from inner surface of the drum pouring down in a cascading motion. Material to be dried enters the dryer, and as the dryer rotates, the material is lifted up by a series of internal fins known as "flights" or "vanes" lining the inner wall of the dryer. The cascading action that the flights impart when dropping it through the air stream maximizes heat transfer between the material and drying air (in the case of direct dryers) as well as carrying moisture from the vegetable material. While the dryer will generally dry the vegetable material, pockets of moisture often remain. Some materials clump and potentially form balls containing that moisture. To dry the interior, these clumps or balls of vegetable material need to be broken up to expose that interior vegetable material to the drying flow. The interior vegetable material must be dried which wastes heated air on the already dried vegetable material. Not all vegetable material will be consistently balled or clumped and might, instead, coalesce in long and stringy chunks which can easily get trapped within the drying mechanism.

A conventional dryer includes a fueled fire in a combustion chamber which either provides heated gasses or directs a heated airflow to heat the interior of the rotary drum. Combustion chambers can be integrated into either co-current (airflow in direction of material flow) or counter current dryers, with the goal being to keep the material from coming into direct contact with the burner flame.

The conventional rotary dryer will include discharge breeching is where two main functions occur: vegetable material exits the dryer, moving on to screening, cooling, storage, or shipping, and the exhaust gas system removes off-gases from the system. At discharge end some openings in the cylinder allow discharge of the vegetable material into the discharge breeching. The breeching encloses the cylinder and bottom part is hoppered and flanged. The breeching face encircling the cylinder is often equipped with a special friction type seal. The top of the breeching has a flanged opening for drying air inlet.

At the feed side, the rotary drum is provided with a feed inlet head equipped with screw conveyor feeder and flanged opening for air and vapor removal. A seal is often provided between the feed inlet face and the rotary drum or cylinder. Exhaust gas systems provide a place for spent gases and hot air (and small particulates) to exit the system. Where a combustion chamber and discharge breeching meet the drum, a seal or pair of seals is needed to connect the stationary component to the rotating drum. The purpose is to keep air and material from leaving the drum prematurely or to escape to the ambient.

Direct dryers are used more frequently than their indirect counterparts, because of the efficiency they offer. Direct dryers rely on direct contact between the material and drying air to efficiently dry materials. Sweep air carries the evaporated moisture along with dust particles from inside the dryer to the exhaust system at the discharge breeching. This process ensures that the material is being dried to the required moisture percentage.

All direct rotary dryers must be equipped with exhaust gas handling equipment. Vegetable material is notoriously flammable among other issues that exist relating to the exhaust gas. Consider, for example, the Washburn A Mill fire on May 2, 1878 in Minneapolis where dried flour dust exploded with such a violent combustion that bits of the mill were found over a quarter of a mile away from the explosion. For that reason, exhaust gas handling equipment is required and additional scrubbing might be necessary where there are unique emissions requirements based upon the material being processed as those requirements are expressed in local, state, and federal regulations.

As discussed above, there is a problem with the conventional rotary dryers in that clumping occurs. Indeed, because of the flow of air on the exterior of a flow of vegetable material tends to "skin" the exterior of vegetable material, the rotary dryers often form these clumps in normal operation. Such clumping prevents uniform drying as dried air cannot reach the interiors of clumps from drying. Disparate materials can often clump together, or stick to the interior of the rotary dryer during the industrial drying process.

One conventional means of preventing clumping is referred to as a knocking system which strikes the exterior of the rotary drum to "knock" material off the interior of the drum as it rotates. Unfortunately, after knocking, further drying is necessary to reach the newly exposed surfaces of the vegetable material. What is missing in the common art of drying vegetable material that avoids this clumping and allows drying air to reach the interior of such clumps of vegetable material as might occur as it is dried.

SUMMARY OF THE INVENTION

A cylindrical drum having a plurality of vanes which extend radially into the drum and extend axially substantially the length of the drum rotates about its axis such that the plurality of vanes convey vegetable material from a lowest point in the interior of the drum to a highest point in the interior of the drum, there, to drop the vegetable matter downward within the interior of the drum. A plenum feeds air through a nozzle opening in a rectangular slot extending in its longest dimension substantially the length of the drum. The plenum and nozzle being housed to form a Coandă-effect nozzle body having a tear-shaped housing. Two Coandă surfaces are situated in opposed relation and terminating at the nozzle. The Coandă surfaces to guide air into a combined flow. A hopper plate cooperates with the housing to form a hopper directing vegetable matter to collide with the combined flow. Negative pressure within the drum assures no propagation of the dust especially as the dust is drawn to feed end of the drum, i.e. pulled from the dry end of the knife to the exhaust and capturing dust in the wetter solids.

A rotary dryer includes a drum defining an interior. The drum, in operation, rotates about its axis in sealed rotatable engagement between a feed-end structure and a discharge-end structure. The feed-end structure defines an infeed hopper further defining an infeed port for admitting vegetable matter into the drum. The feed-end structure further defines an exhaust port. In operation, an exhaust blower draws an exhaust volume of heated air and dust from the interior of the drum through the exhaust port. A plenum passes into the interior of the drum. An intake blower blows an intake volume of heated air into the plenum passing the intake volume into the drum for drying vegetable matter. The intake volume is selected not to exceed the exhaust volume. A discharge-end structure defines a discharge chute for removing vegetable matter from the interior of the drum. The exhaust blower is connected to blow the exhaust volume of heated air and dust into a cyclone separator. The cyclone separator allows the heated air to escape to the ambient and to drop dust into the infeed hopper to mix with the vegetable matter as the vegetable matter is admitted into the drum.

DETAILED DESCRIPTION OF THE PREFERRED EMBODIMENT

The Coandã effect is the tendency of stream of fluid to stay attached to a curved surface, rather than to follow a straight line down in its original direction. The Coandã effect is also known as "boundary layer attachment" and was named after the Romanian discoverer Henri Coandã, who was the first to understand the importance of this phenomenon for aircraft development. The Coandă-effect describes a laminar flow of gas (or liquid) that follows a surface as it passes over it. To form a lamina, however, the flow must be organized with a rectangular cross-section.

A free jet of air entrains molecules of air from its immediate surroundings causing an axisymmetrical "tube" or "sleeve" of low pressure around the jet. The resultant forces from this low pressure tube end up balancing any perpendicular flow instability, which stabilizes the jet in a straight line. However, if a solid surface is placed close, and approximately parallel to the jet, then the entrainment (and therefore removal) of air from between the solid surface and the jet causes a reduction in air pressure on that side of the jet that cannot be balanced as rapidly as the low pressure region on the "open" side of the jet. The pressure difference across the jet causes the jet to deviate towards the nearby surface, and then to adhere to it. The jet adheres even better to curved surfaces, because each (infinitesimally small) incremental change in direction of the surface brings about the effects described for the initial bending of the jet towards the surface. If the surface is not too sharply curved, the jet can, under the right circumstances, adhere to the surface even after flowing 180° round a cylindrically curved surface, and thus travel in a direction opposite to its initial direction. The forces that cause these changes in the direction of flow of the jet cause an equal and opposite force on the surface along which the jet flows. This tendency to follow such surfaces is known as the Coandă-effect.

Figure 1:
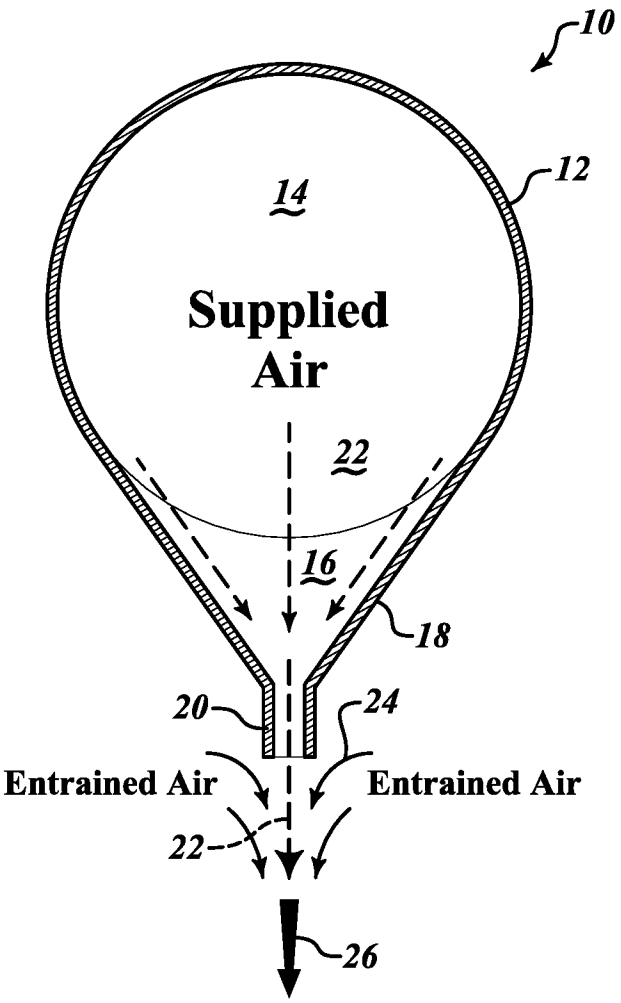
FIG. 1 is a functional drawing setting forth the operation of the Coandă-effect nozzle body.

FIG. 1 shows a Coandă-effect nozzle body 10. A bulbous housing 12 receives a supply of air in a plenum 14 at a pressure higher than that of the ambient atmosphere. Naturally, the higher pressure of the supply of air, carried in a plenum 14 situated within the housing 12 causes an organization of the air into a flowing jet 22 from the higher pressure of the air of the interior 16 of the housing 12 into a jet of air escaping the nozzle 20. As the organized flow of air from the interior 16 escapes from the housing 12 through the nozzle 20, it forms into a jet 22. Due to the orientation of the jet 22 relative to the exterior surfaces adjacent to the nozzle 20 (referred to herein as Coandă surfaces 18 which due to their smoothness allows an organized flow of air along them), the escaping jet 22 causes the predicted low pressure "sleeve" into which that organized flow of air is drawn in as "entrained air". The entrained air 24 flows along the surface thereby enhancing greatly the volume of air that flows with the escaping jet 22 as a resulting air flow 26.

This signature structure, the Coandă-effect nozzle body 10, is recognizable for its inverted "tear drop" shape as it includes a plenum 14 conjoined with a nozzle 20 to form a housing 12 whose exterior defines these two Coandă surfaces 18 in opposed relation cooperating to entrain air into this resulting air flow 26. The organized flow of entrained air 24 remains highly organized as a laminar flow. This laminar flow of entrained air 24 efficiently amplifying the flow of air as it issues out of the rectangular nozzle 20. The Coandă surface 18 is curved to draw surrounding air over its generally smooth surface shaped such that air is drawn in and organized as a laminar sheet in flow of air there-over.

Importantly, to achieve this effect, the jet 22 must be long enough extending in a direction perpendicularly to the sheet containing FIG. 1 to form a slot. To achieve a Coandă-effect, the nozzle must be formed as an elongate slot. That jet 22 with its rectangular cross-section acts as a fence formed along the slot, the jet 22 then acts to isolate the effects of air currents on one side of the jet 22 from disorganizing arranged entrained air 24 on the opposing side. The rectangular cross-section of the jet 22 asserts such an organization of the entrained air 24 to form as laminar sheets coming together as the resulting air flow 26, which shall, through the rest of this application be referred to as the "air knife" with this same reference number 26.

Figure 2:
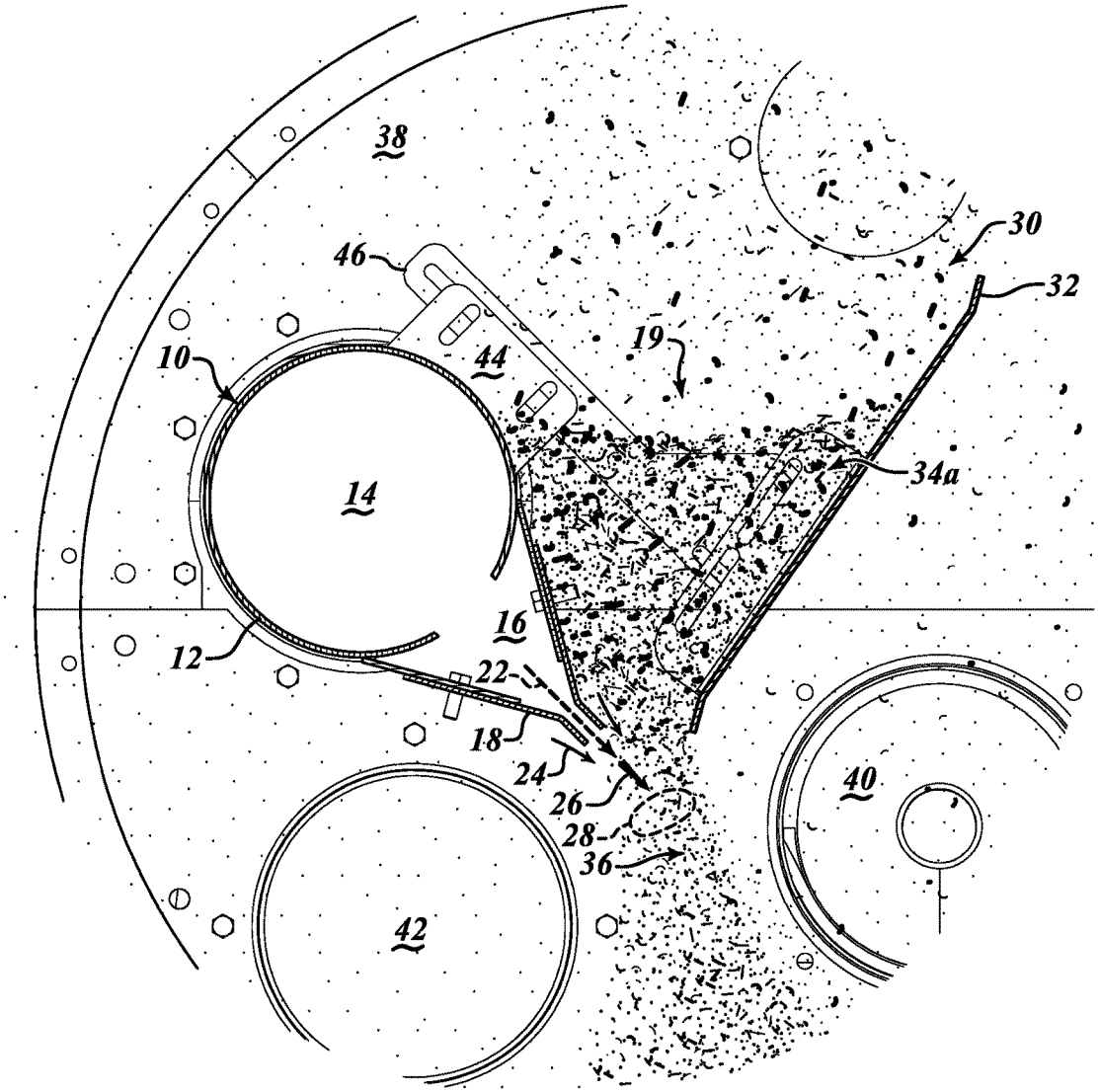
FIG. 2 is a detail cross-section of the rotary drum dryer showing the Coandă-effect nozzle body cooperating with the hopper plate to form a hopper to collect vegetable material.

Moving, then, to FIG. 2, the Coandă-effect nozzle body 10 is, as stated above, readily recognized by its bulbous teardrop-shaped housing 12. Placed as it is, in opposed relation to a hopper plate 32, the Coandă surface 18 completes a hopper 19 to receive stacked vegetable material 34*a* as the airborne vegetable particulate 30 drops, by gravity, to collect in the interspace between the hopper plate 32 and the Coandă surface 18. Additionally, the spatial relationship between the Coandă-effect nozzle body 10 by a housing bracket as affixed and secured to a hopper plate bracket 46 that holds the hopper plate 32.

The resulting hopper 19 feeds the stacked vegetable material 34*a* into a collision region 28 wherein a flow of stacked vegetable material 34*a* collides with the air knife 26. In that collision region 28, this air knife 26 performs three important functions: 1) to tear, because of the distinct velocities and directions of the flows of the stacked vegetable material 34*a* and the air knife 26 breaking up clumped stacked vegetable material 34*a* into its smallest particles; 2) bathing the now broken up clumped stacked vegetable material 34*a* with heated air drying the vegetable material more completely and quickly (Small or thin objects have a large surface area compared to the volume. This gives them a large ratio of surface to volume. Larger objects have small surface area compared to the volume so they have a small surface area to volume ratio. A large lump, for example, has a small ratio, and may be smashed into powder to give it a large surface to volume ratio.); and 3) accelerating stacked vegetable material 34*a* moving it rapidly out of the collision region 28 in an aerosol of vegetable material 36 making room for more stacked vegetable material 34*a* to collide with the air knife 26. Each of these three important functions enhances the drying efficiency of the rotary dryer.

Also visible in FIG. 2, is the feed end of an auger 40 which feeds the vegetable material into the interior of the dryer. An auger such as the auger 40 is selected as a feed means because the auger 40, when suitably loaded with vegetable material 34 being fed into the interior of the drum 38 acts as an airtight seal prevent air from the ambient atmosphere from entering the interior of the drum 38 past the auger 40. As such, there are only two significant movements of air relative to the interior of the drum, either exhausting through air withdrawal port 42 or entering through the plenum 14. As such, with the auger 40 properly loaded, control systems running the furnace blower 98 and the air withdrawal squirrel-cage blower 76 can be set to select speeds to balance the volume of air being drawn out of the interior of the drum 38 by the air withdrawal squirrel-cage blower 76 and being introduced into the interior of the drum 38 by the furnace blower 98 through the plenum 14. So, as configured, in operation, the auger 40 functions as an air-lock.

Also, another innovation is present in the form of the air withdrawal port 42 upon which more will set forth relative to the discussion of dust control set forth below. The air withdrawal port 42 is located within the interior of the drum 38 in a space where a vortex that the air knife 26 creates throws heavier vegetable material dust in an aerosol of vegetable material 36 outward to be captured by the vanes 66 at the outer extremes of the interior of the drum 38 leaving the air at the air withdrawal port 36 largely free of dust. Such dust that is there is drawn through the air withdrawal port 42 is generally quite fine as it is less influenced by centrifugal force than the heavier vegetable material 38. Thus, air is withdrawn through the air withdrawal port 42 to balance the volumes of air necessarily introduced through the plenum 14 to form the air knife 26. This feature of the invention allows the control of dust as described below.

Figure 3:
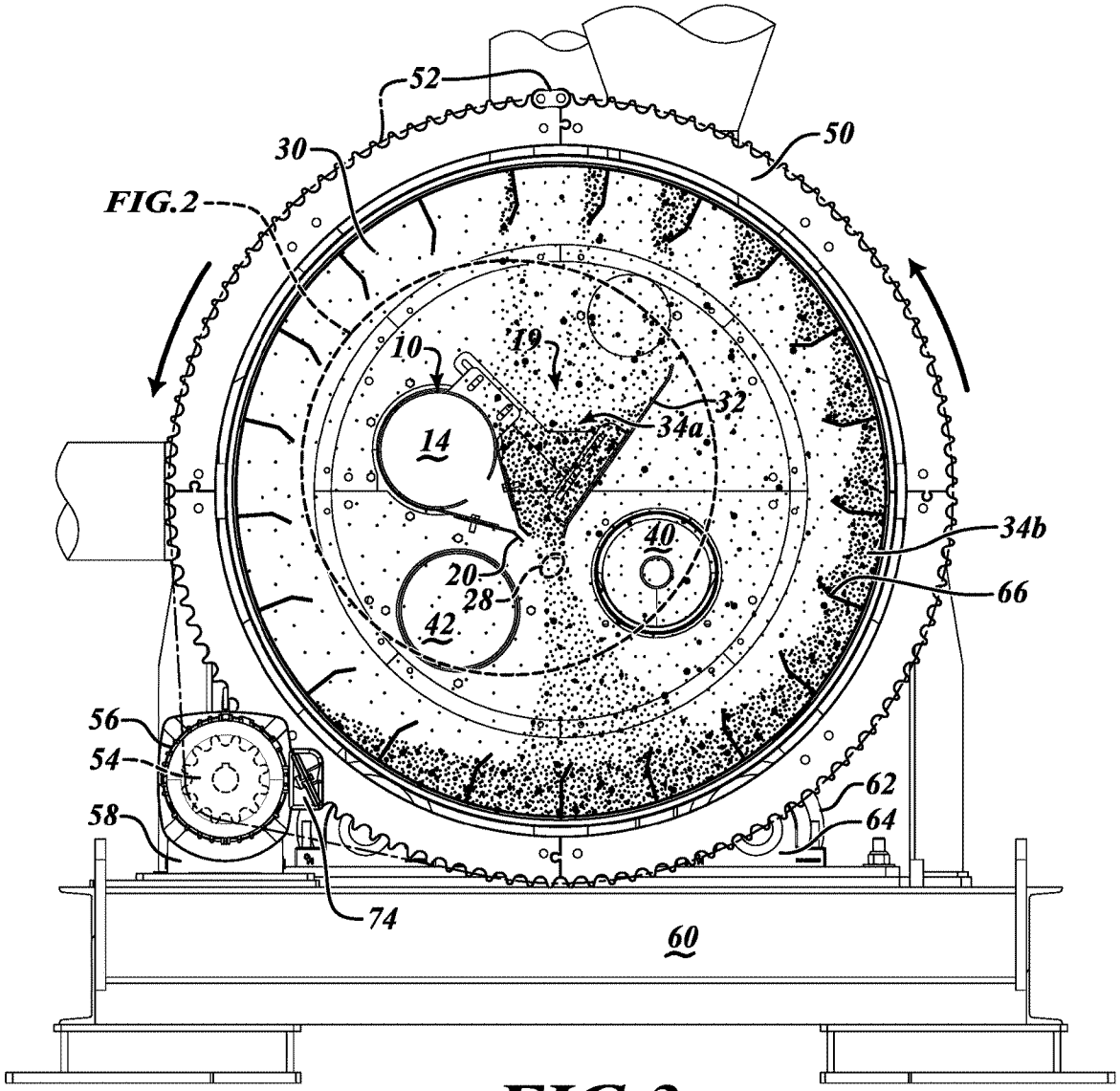
FIG. 3 is a broader cross-section of the rotary drum dryer showing the Coandă-effect nozzle body cooperating with the hopper plate to form a hopper to collect vegetable material as well as the operation of the vanes to convey that vegetable material to the hopper.

FIG. 3 is provided to put the Coandă-effect nozzle body 10 in context in the greater environment of the interior of the rotary drum 38. Stepping back from the detail view of FIG. 2, the drying cycle of the rotary drum dryer is on display. Resting on a foundation 60, the rotary dryer drum 38 rotates on pairs of rollers 62, themselves supported by roller brackets 64 bedded on the foundation 60. As such, the rotary drum 38 can rotate freely between the stationary structures at each of the feed end and the discharge end of the rotary drum dryer. To facilitate this rotation, the drum 38 is ringed by a driven sprocket wheel 50 assembled in sectors to encompass the rotary drum 38 as it rests on the rollers 62. A motor 56 is also bedded on the foundation 60, in this instance with a motor bracket 58. A chain 52 engages the driven sprocket wheel 50 and engages a sprocket drive wheel 54 which, itself, is mounted on a motor shaft (not shown). Thus, when the motor 56 is energized and the shaft of the motor begins its rotation, the rotary drum 38 rotates. Within the drum 38, vanes 66 carry vegetable material 34*b* resting between the vanes 66 with the rotating drum 38 up the side of the drum 38 much as passengers ride cars to the top of a Ferris wheel. As the vanes 66 approach the top of the drums rotation, gravity drops the vegetable material downward from between the vanes 66. The vegetable particulate 30 falls to collect in the hopper 19 the Coandă-effect nozzle body 10 and the hopper plate 32 cooperate to form as discussed relative to FIG. 2 above.

While in normal operation, the inventive dryer might obtain as much as a thirty five percent reduction in moisture content within the vegetable particulate 30, stacked vegetable material 34*a*, and interspace vegetable material 34*b* shown herein. One can readily imagine that in beginning rotation, especially if some of the interspace vegetable material 34*b* already resides between the vanes 66 and if moist, its weight would tax the motor 56. To protect the motor 56, a thermal cut-off relay 74 is provided. Thermal cut-off relays 74 protect the motor 56 by cutting power from the motor 56 if the motor 56 draws too much current for an extended period of time. To accomplish this, thermal cut-off relays 74 contain a normally closed (NC) relay. When excessive current flows through the motor circuit, the relay opens due to increased motor temperature, relay temperature, or sensed overload current, depending on the relay type. Thermal cut-off relays 74 are similar to circuit breakers in construction and use, but most circuit breakers differ in that they interrupt the circuit if overload occurs even for an instant. Thermal overload relays are conversely designed to measure a motor's heating profile; therefore, overload must occur for an extended period before the circuit is interrupted. Peak and sporadic overloads are generally not damaging to the motor 56.

Figure 4:
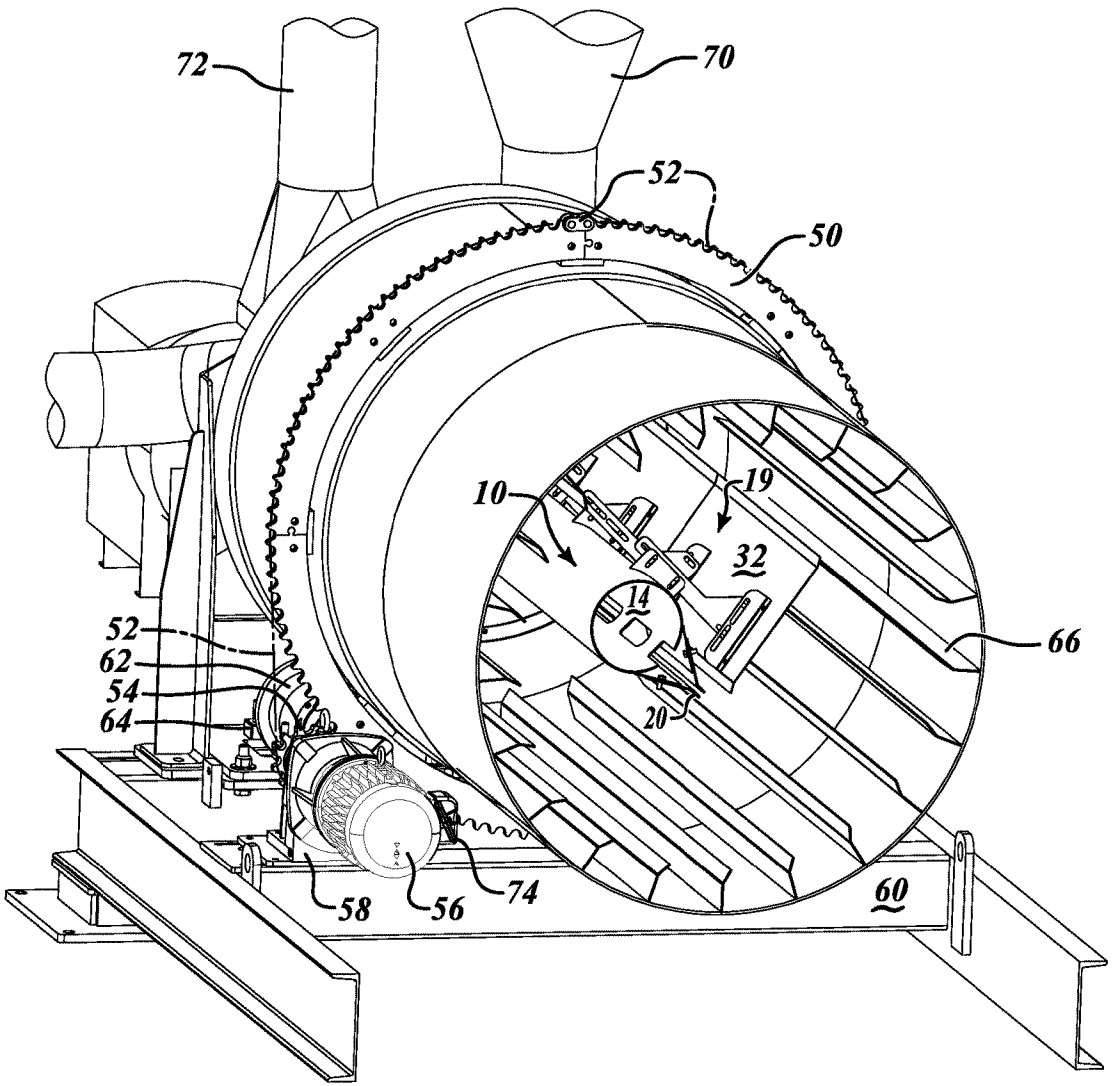
FIGS. 4 and 5 are each a perspective view in cross-section of the feed end of the rotary drum dryer showing the Coandă-effect nozzle body cooperating with the hopper plate to form a hopper to collect vegetable material.
Figure 5:
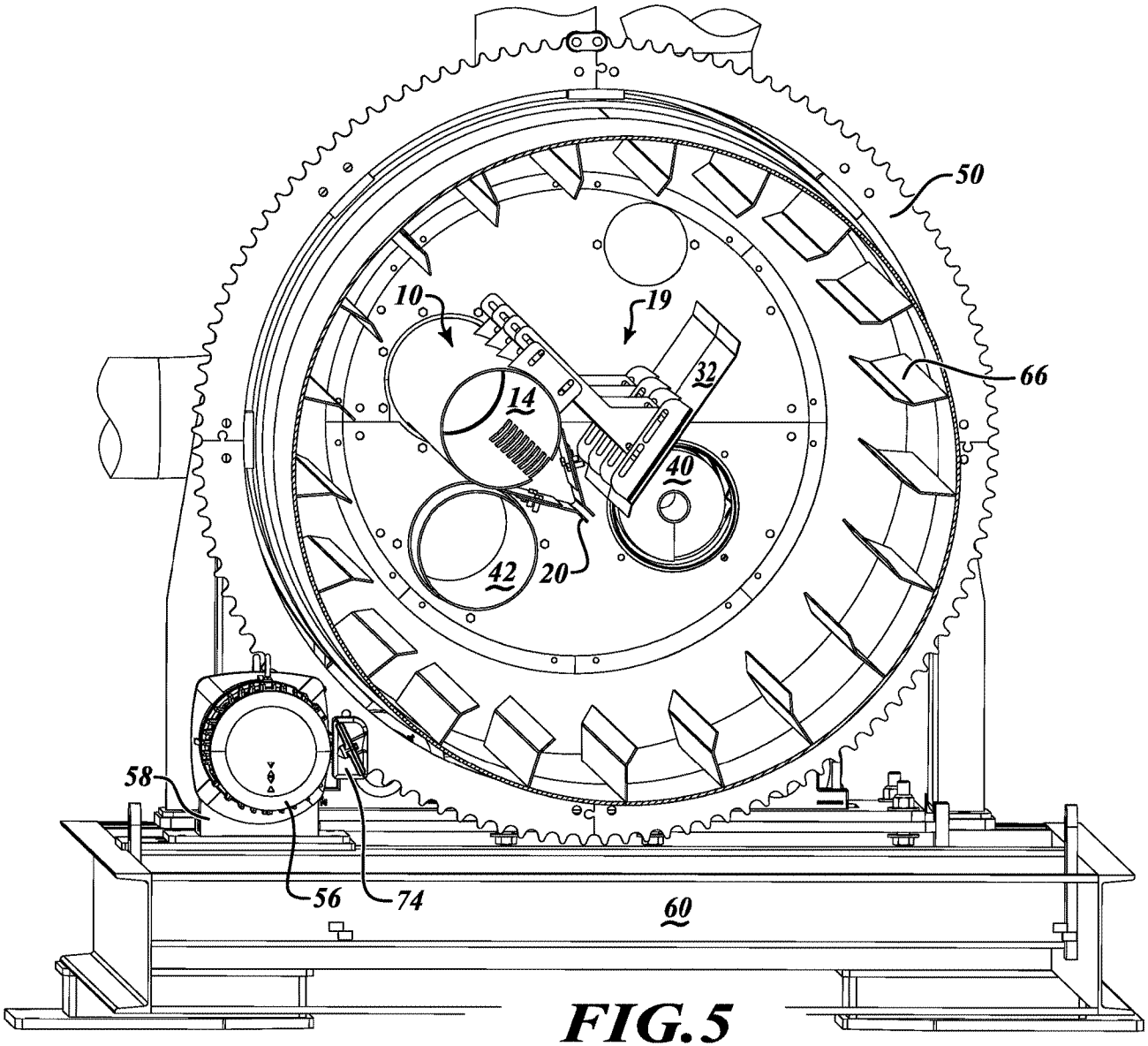

To place the same elements described with reference to FIG. 3 into better context than might be available in its pure cross-section, FIGS. 4 and 5 portray these same elements in a perspective view. Notable here in FIGS. 4 and 5 are the hopper plate 32 and the Coandă-effect nozzle body 10 and the plenum 14 within the housing, situated as it is to supply the nozzle 20. Advantageously, in this embodiment, the tubular form of the plenum 14 and the rigidity it imparts serves as a support for the Coandă-effect nozzle body 10 and, thus, in turn, the hopper plate 32. The vanes 66 to convey interspace vegetable material 34*b* (not shown herein) as the drum rotates to the top of the drum 38 where gravity draws the vegetable material 34*b* from between the vanes to, then, fall to the hopper plate 32. The whole of the drive system as described with reference to FIG. 3 above is also visible.

Figure 6:
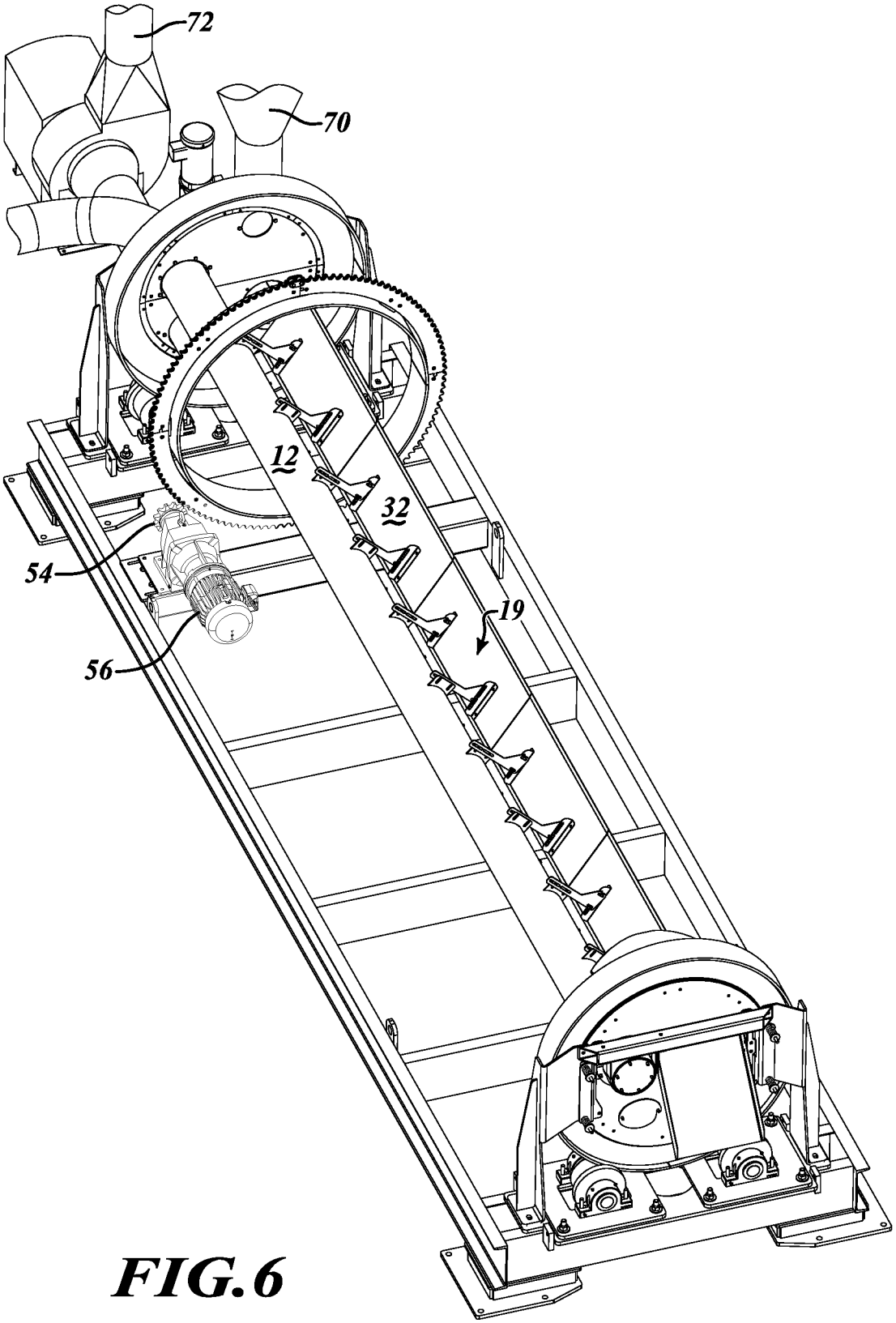
FIG. 6 is a skeletal view of the rotary dryer without the drum in order to show the arrangement of the plenum, hopper plate and discharge chute.
Figure 7:
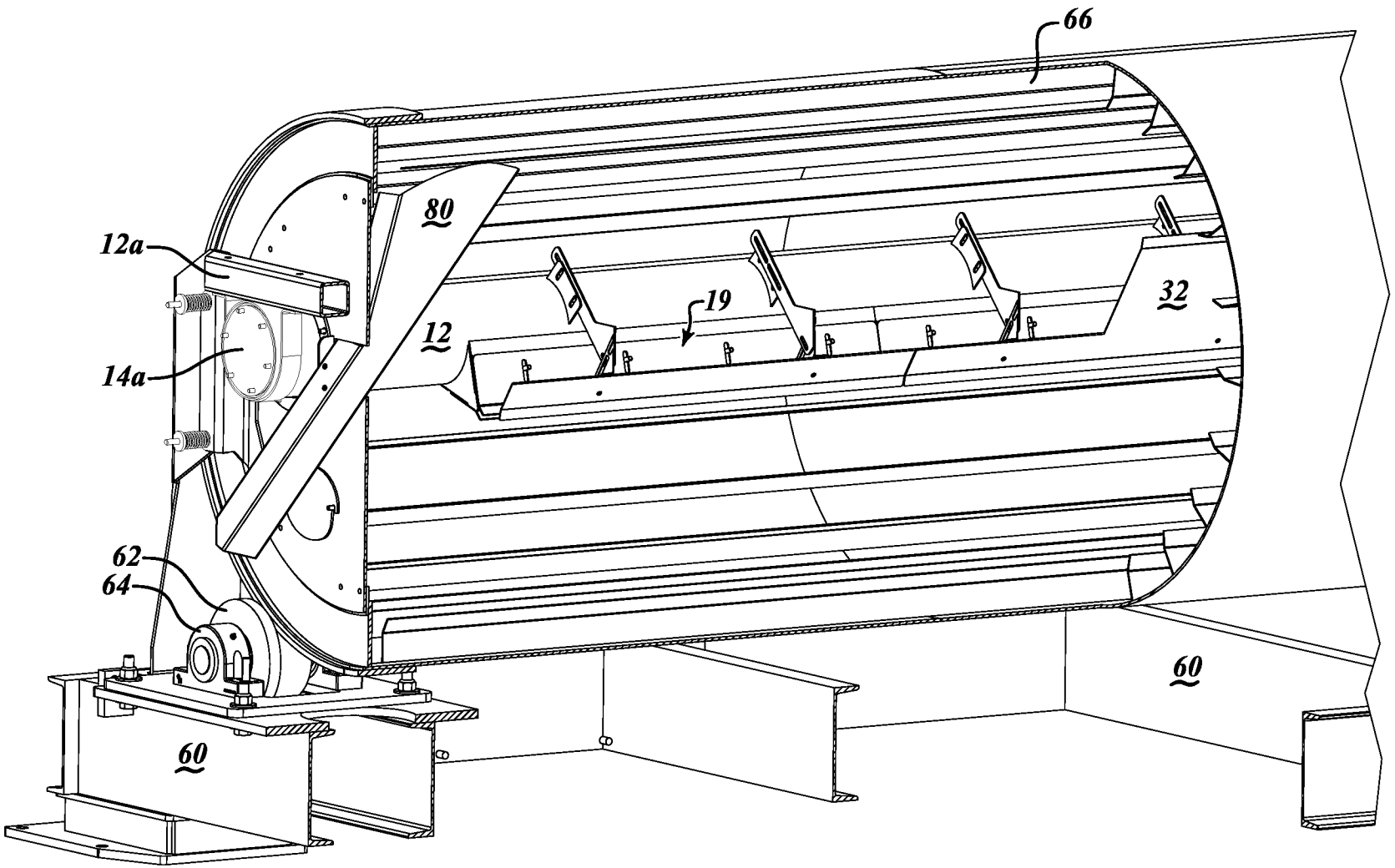
FIG. 7 shows the vanes, plenum, hopper plate and discharge chute to take material from the interior of the drum.

FIGS. 6 and 7 are provided to assist in the understanding of movement of vegetable material 34 through the rotary drum dryer. In free surroundings, a jet of fluid entrains and mixes with its surroundings as it flows away from a nozzle 20. Thus, once the air knife 26 (FIG. 2) flow leaves the collision region 28, the flow actually motivates the aerosol of vegetable material 36 along the drum 38 (FIG. 2). An aerosol is a suspension of fine solid particles or liquid droplets, in air or another gas. As such, the particles themselves tend to act more like a liquid than as an aggregate of solid particles. These particles will tend to flow and much as water seeks its own level, the particles will move down the drum 38 along the vanes 66. That flow motivates the particles within the aerosol of vegetable material 36 down the drum 38 towards the discharge end of the drum 38.

As demonstrated in the skeletal view of the rotary drum dryer in FIG. 6, the housing 12 extends the entire length of the drum 38 (not shown in the FIG. 6) serving as the hopper 19 within. As more vegetable material 34 is introduced on the feed end of the drum 38, rather than merely to stack up at that end, the material will appropriately assume a helical path down the drum 38.

In viewing FIG. 7 and recalling FIG. 3, one can readily understand that interspace between any pair of vanes 66 acts much as a pool such that the aerosol of vegetable material 36 will settle across that interspace much as water issuing from a garden hose into a corner of child's wading pool will fill the pool evenly, the level advancing on any side of the pool at the same rate and instantaneously at the same height. As that interspace advances up the side of the drum 38, the interspace vegetable material 34*b* from interspace spills out and falls as particles of vegetable particulate 30 and along most of the length of the drum 38, restarts its trip from the hopper 19 as shown in FIG. 2. Only at the discharge end, where the hopper plate 32 ends and the discharge chute 80 takes its place such that vegetable particulate 30 collects in the chute and slides out of the drum 38.

Also visible in FIG. 7 is the discharge end of the rotary drum dryer, a structure that is stationary while the drum 38 rotates. Importantly, the housing is supported at its discharge end with a housing support 12*a*. An inspection port 14*a* is provided to allow viewing and cleaning the interior of the plenum 14.

Having described fully the path of vegetable material through the drum 38, a second innovation in the rotary dryer is that of retaining dust within the dryer. As stated in the background above, vegetable material dust is extremely flammable. Consider, for example, the Washburn A Mill explosion. In the spring of 1878, the original Washburn A Mill exploded in a fireball of flames, thrusting debris hundreds of feet into the air. In a matter of seconds, a series of thunderous explosions—heard 10 miles away in St. Paul—destroyed what had been the city's largest industrial building, along with several adjacent mills. At the inquest into the deaths of the 18 workers, John A. Christian, the A Mill's manager, explained that the disaster had been caused by rapidly burning flour dust.

Dust presents another hazard as well. Using flour again as an example, because of its apparently benign and common nature, few people realize that it is a hazardous material. Workers in baking-related jobs may inhale flour dust when it becomes airborne. The dust can irritate the respiratory tract and lead to occupational asthma, also known as baker's asthma. The health problems can develop over 30 years. Naturally, other vegetable material dust can present equally or, in fact, to a far greater extent, a real danger to the workers who might breathe such dust.

Figure 8:
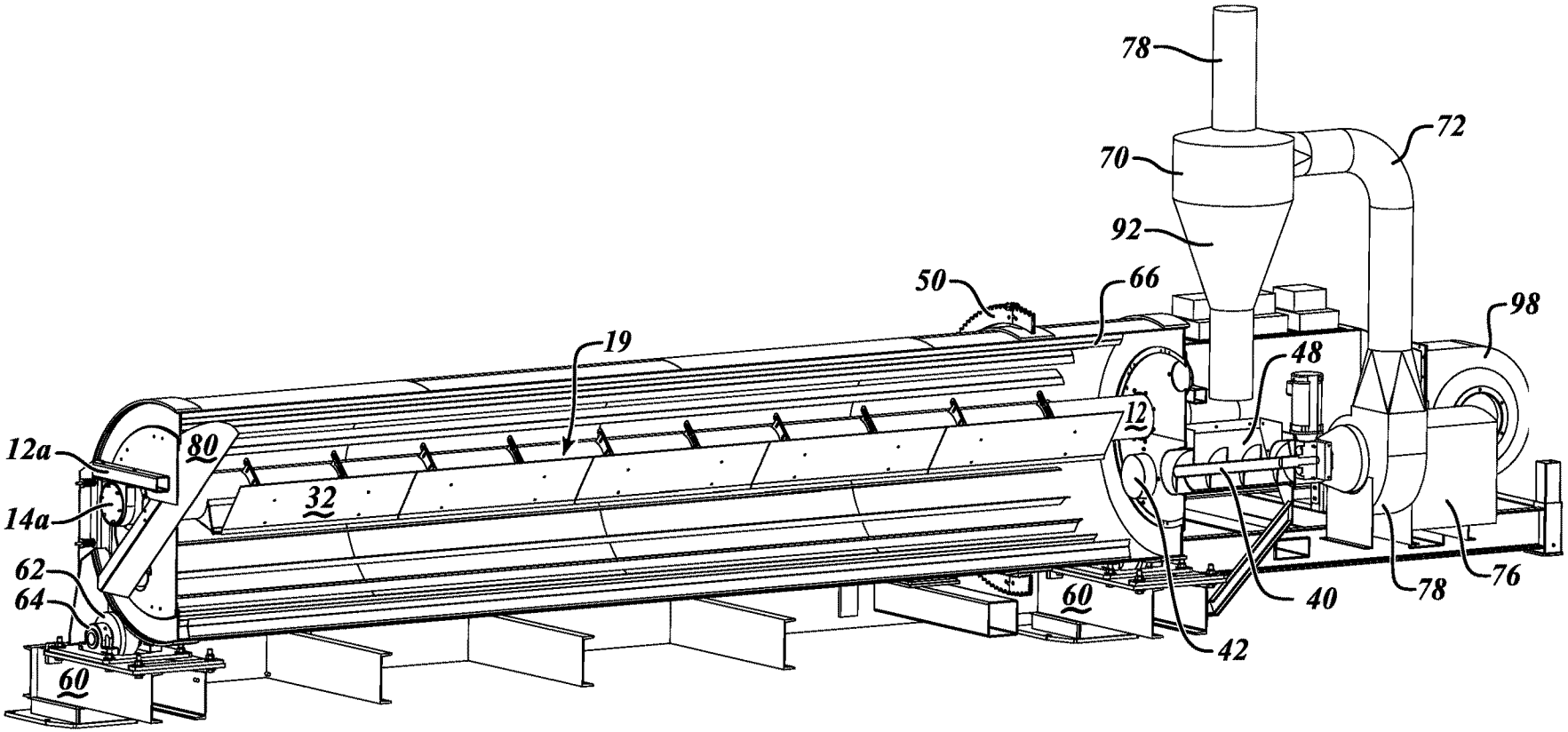
FIG. 8 shows, in cross-section and FIGS. 9 and 10 the entirety of the rotary dryer including the exhaust and intake air handling equipment including the heated air blower and the exhaust air handling equipment.
Figure 9:
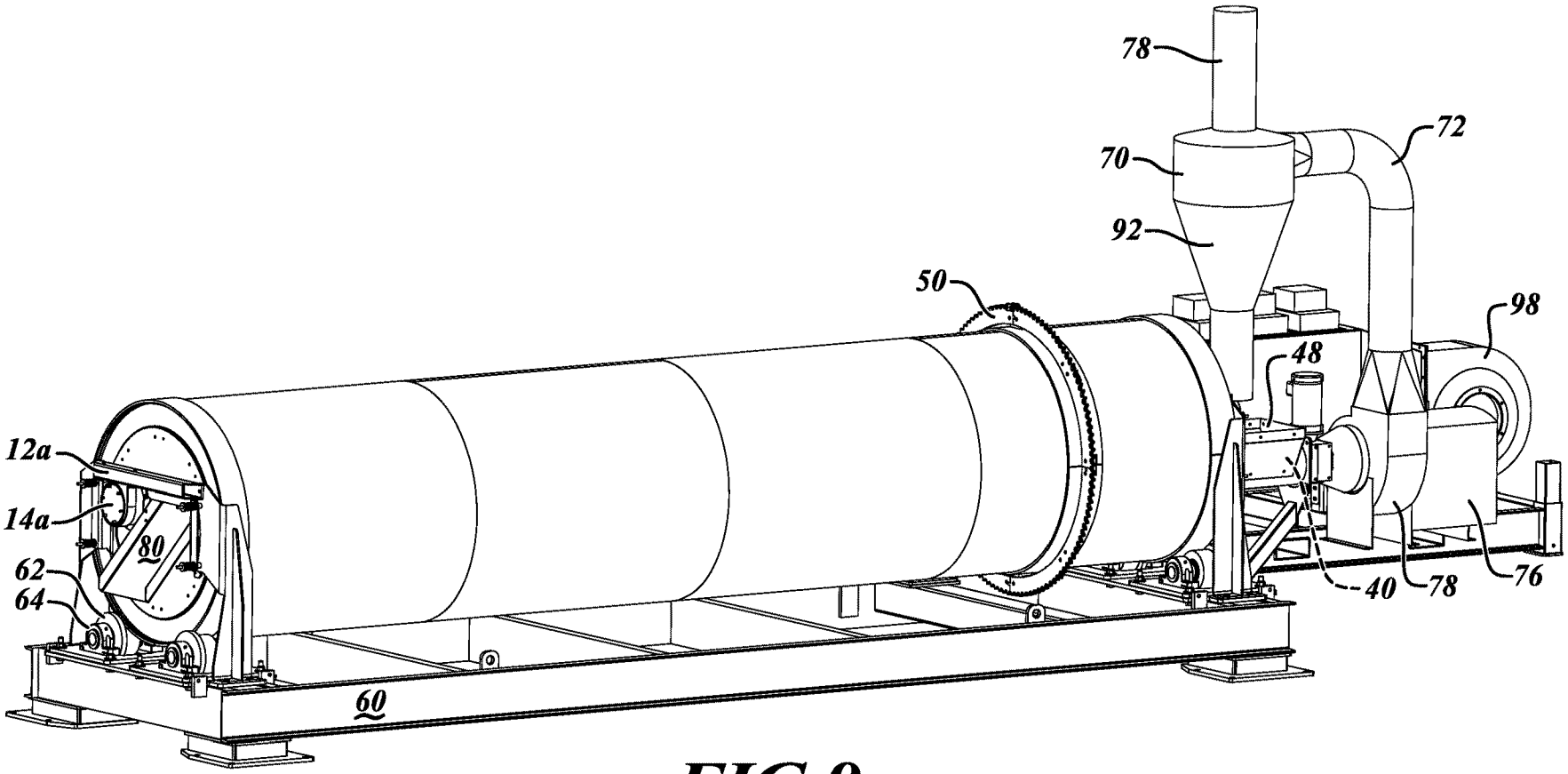
Figure 10:
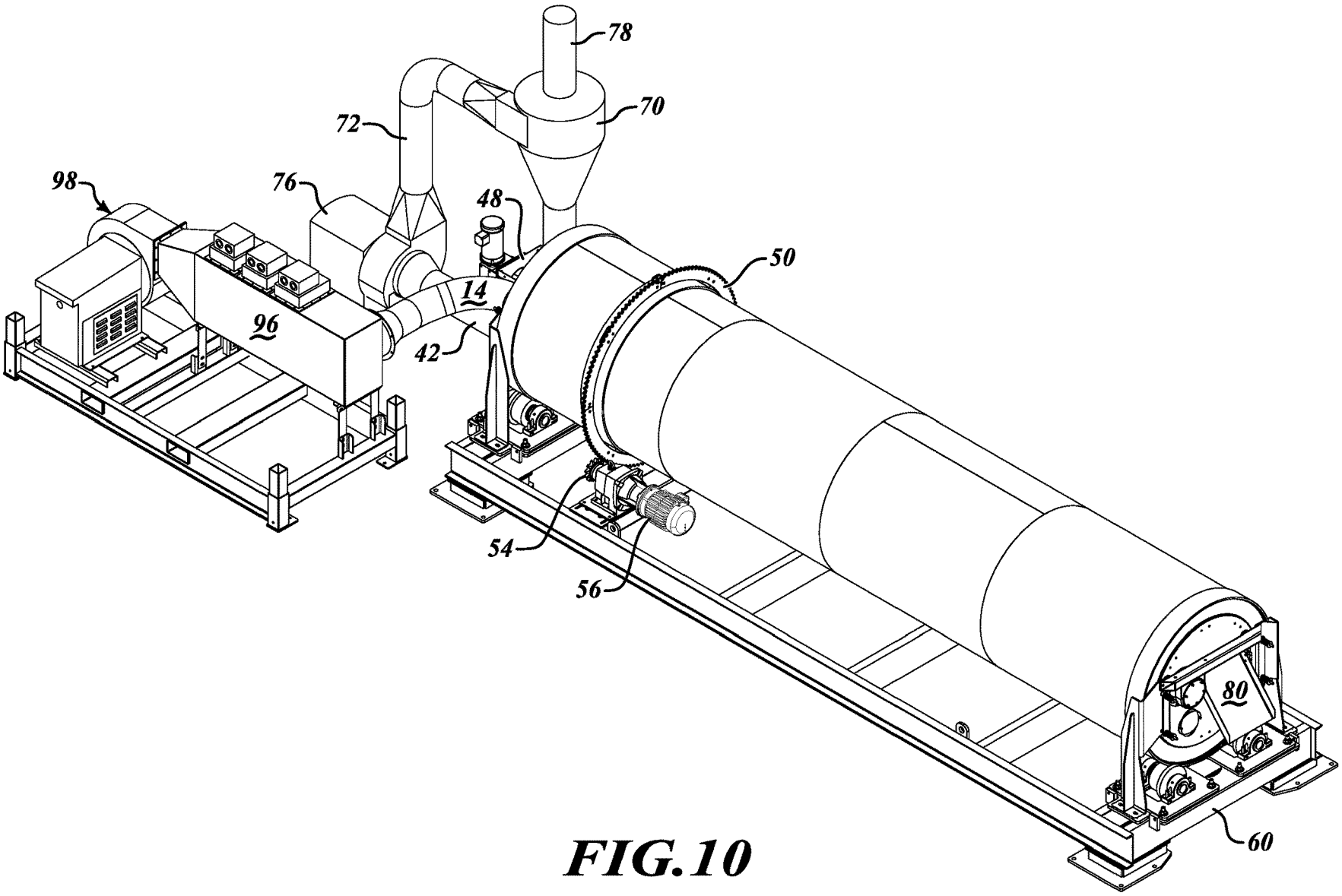

To contain such dust, the inventive rotary drum dryer exploits a closed-loop system to control the flow of heated air through the dryer. Referring, then, to FIGS. 8, 9 and 10 a path of air through the dryer can be traced. As we have described the pressurized flow into the plenum 14 above, especially relative to FIGS. 2 and 3, this might be the easiest place to begin. Air issues from the plenum 14 through the nozzle 20 and into the interior of the dryer drum 38 to carry stacked vegetable material 34*a* in an aerosol of vegetable material 36 downward to the interspace between vanes 66. It is notable that apart from the discharge chute 80, there is no outlet in the discharge end structure, for heated air to escape the dryer. A closer examination below relative to FIGS. 12A and 12B below does discuss an embodiment having a small port 82 for sensing pressure within the drum 38 relative to ambient pressure.

Returning then to the embodiment illustrated in FIGS. 8, 9 and 10, the air introduced as the air knife 26 must be removed as well lest the pressure within the interior of the drum 38 cause the explosive discharge of vegetable material 38 through the discharge chute 80. To prevent such a discharge, the excess air within the drum 38 is removed by means of the air withdrawal port 42 (FIG. 5). Located as it is, in this preferred embodiment, on the feed side of the drum 38, it is also beneath the housing 12 and nozzle 20 (FIGS. 2, 3, 4, and 5) such that the nozzle 20 actually directs the air knife 26 past and away from the air withdrawal port 42 such that only a minimum of vegetable particulate 30 is drawn from the interior of the drum 38 through the exhaust port 42.

Because of the air withdrawal port 42 is placed in an advantageous location, free from most of the vegetable particulate 30, the air draw from the interior of the drum 38 is laden, mostly, with the lightest or smallest vegetable particulate 30 as it is the most readily swirled about in the turbulence the air knife 26 generates as it stirs the interior air. As is seen in FIG. 10, the air withdrawal port 42 extends into a blower 76. In the present embodiment, the blower 76 is of the squirrel-cage variety.

A squirrel cage blower, also known as a centrifugal blower, is so named since its construction looks similar to that of a hamster wheel. Squirrel fans are known for their superior energy efficiency compared to other types of blowers. They are also durable, reliable, relatively quiet, and capable of operating in a broad range of environmental conditions. These types of blowers use kinetic energy to increase the velocity and capacity of the air stream; thus differentiating them from positive displacement blowers, such as conventional fans, which use mechanical energy to physically move the air from the inlet to the outlet.

At the heart of the squirrel-cage blower 76 is an impeller which is a circular or cylindrical mechanism with a series of curved vanes 66. As the impeller rotates, the air surrounding it also rotates at the same speed. This action imparts a centrifugal force to the air, causing it to move radially outwards to the walls of the squirrel-cage blower 76 or fan housing 12. The air follows a spiral trajectory—increasing in pressure and velocity—until it exits the discharge end of the squirrel-cage blower 76. In the presently preferred embodiment of the inventive dryer, the squirrel-cage blower 76 has proven to be the most advantageous means to draw air from the interior of the drum 38.

The squirrel-cage blower 76 is a constant-displacement or constant-volume device, meaning that, at a constant fan speed, a squirrel-cage blower 76 moves a relatively constant volume of air rather than a constant mass. As such, regulating the speed of the squirrel-cage blower 76 regulates the volume of air the squirrel-cage blower 76 moves. In most conventional squirrel-cage blowers, the impeller is belt-driven such that motor, belt and pulleys are selected to spin the impeller at a selected speed based upon design parameters. Because the volume of air driven into the plenum 14 is known, each of the squirrel-cage blowers 76 that feed air into the drum 38 and that drawing air out of the drum 38 can be selected such that, in operation, a slight air flow into the drum 38, is drawn into the discharge chute 80 thereby preventing the escape of dust from the drum 38 actually "rinsing" discharged vegetable matter with a current of inflow air as it exits the drum 38.

Figure 12B:
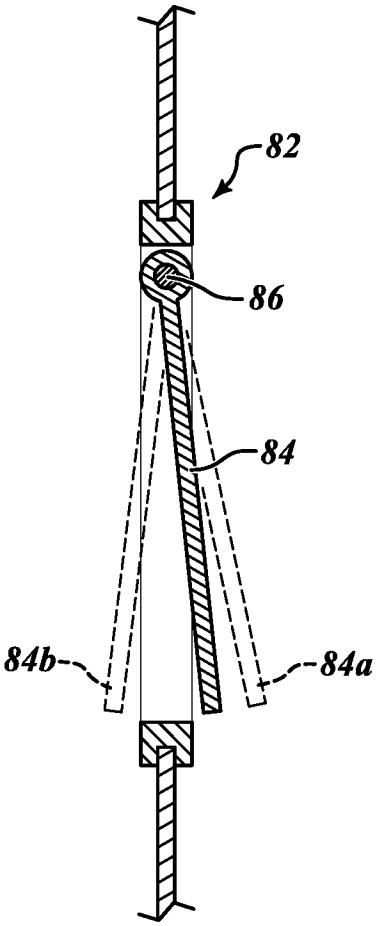
FIGS. 12A and 12B show the pressure sensing vane and pressure sensing port in the discharge breeching.
Figure 12A:
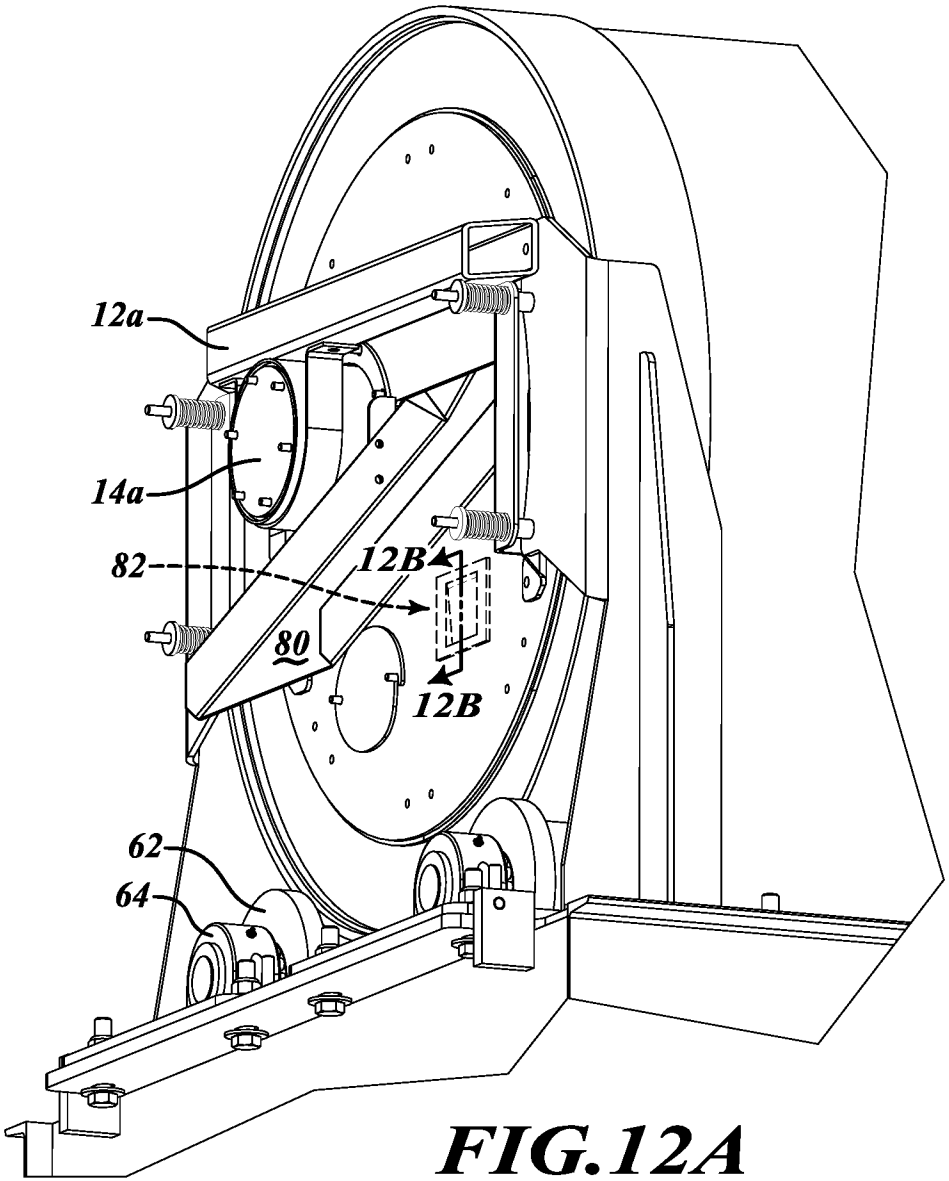

In an alternate embodiment shown in FIGS. 12A and 12B, air is supplied to the plenum 14 in a volume selected to optimally dry that volume of vegetable matter and by means of a pressure sensing vane 84 pivoting on a hinge 86 hung in a sensing port 82. Optimally, the vane 66 is drawn slightly into the interior of the drum 38 into a position such as that shown as 84*a*, indicating that the pressure within the drum 38 is slightly less than that of the ambient atmosphere. Should the pressure inside the drum 38 be allowed to climb to a pressure greater than that of the ambient, the pressure sensing vane 84 is pressed to the position shown as 84*b*, inclined out of the drum 38.

A simple feedback loop is available, therefore. By selecting the optimal position, a rotation speed of the squirrel-cage blower 76 can be selected to place the pressure sensing vane 84 in the optimal position 84*a*. Pressure within the interior of the drum 38 can be regulated by the speed of the squirrel-cage blower 76 and, thus, a variable drive blower can be used to maintain an optimized pressure within the drum 38. Variable drive blowers may use hydraulic or magnetic couplings (between the impeller wheel shaft and the motor shaft) to vary speed in a controlled manner generally by allowing the impeller wheel shaft to slip relative to the motor shaft.

In some embodiments blower speed controls can be integrated into automated systems to maintain the desired impeller shaft rotational speed. An alternate method of varying the fan speed is to use an electronic variable-speed drive to control the rotational speed of the motor which, in turn, is mechanically connected driving the fan. A variable speed motor controller offers a better overall energy efficiency than mechanical couplings, especially at greatly-reduced speeds.

In this manner, for example, optimum air flow may be achieved by using such as a phase-locked loop feedback mechanism, the volume of vegetable matter fed into the dryer will always receive the optimum flow of drying air based upon the position of the pressure sensing vane 84 and its proximity to the optimum position 84*a*. A phase-locked loop or phase lock loop ("PLL") is a control system that generates an output signal whose phase is related to the phase of an input signal. There are several different types; the simplest is an electronic circuit consisting of a variable frequency oscillator and a phase detector in a feedback loop. The oscillator generates a periodic signal, and the phase detector compares the phase of that signal with the phase of the input periodic signal, adjusting the oscillator to keep the phases matched. Keeping the input and output phase in lock step also implies keeping the input and output frequencies the same. Consequently, in addition to synchronizing signals, a phase-locked loop can track an input frequency, or it can generate a frequency that is a multiple of the input frequency. If an oscillator can generate a frequency based upon a position of the pressure sensing vane 84, the rotational speed of the impeller and the position of the pressure sensing vane 84 can be correlated in this PPL manner.

Figure 11:
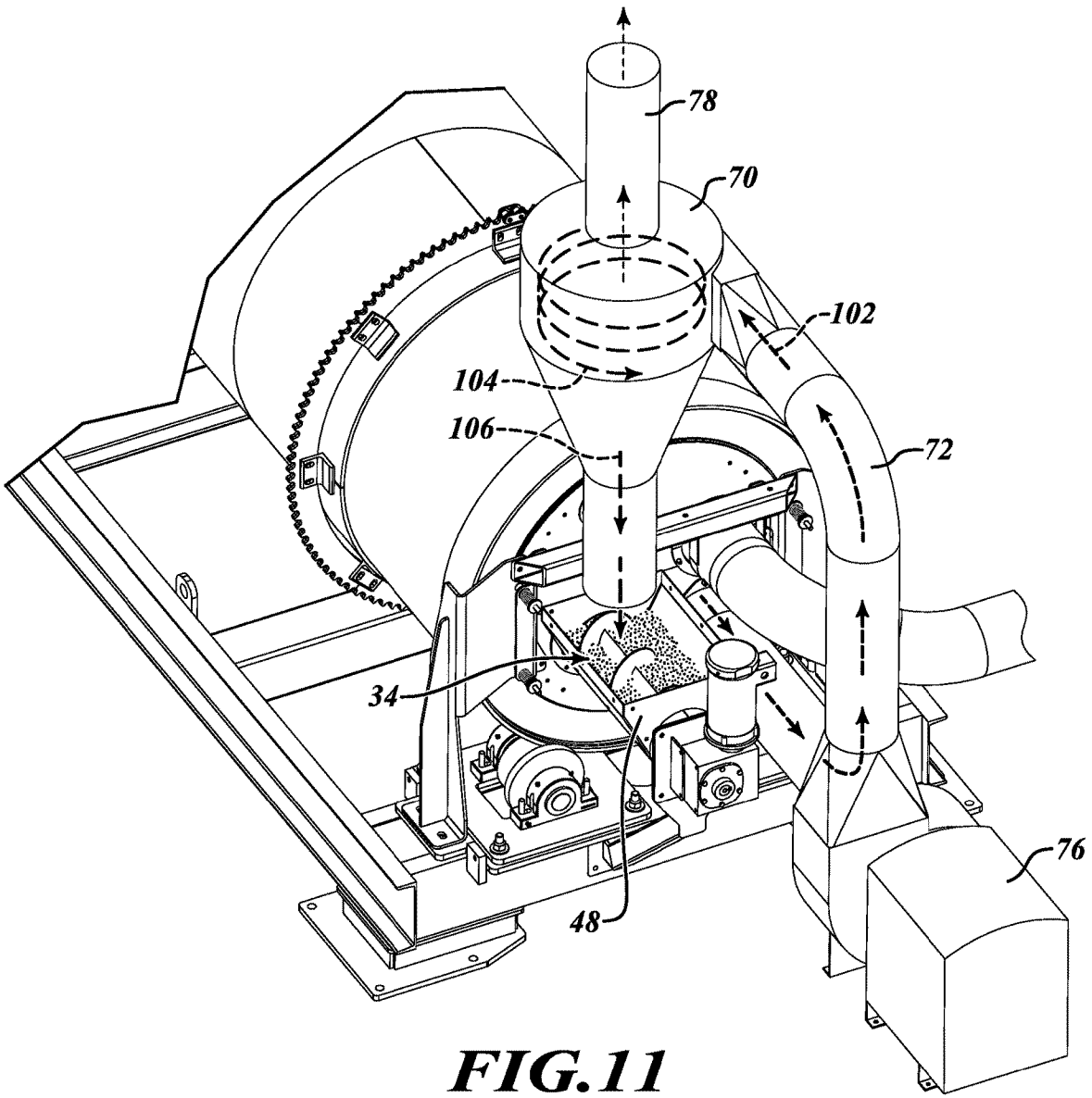
FIG. 11 shows the path of exhaust air through a cyclone separator.

Referring now to FIG. 11, the air drawn from the drum 38 through the air withdrawal port 42 as that port extends into the squirrel-cage blower 76 such that the volume withdrawn from the drum 38 is transported as a flow of dust and air 102 into a cyclone chamber 70. Cyclone separators work much like a centrifuge, but with a continuous feed of air and entrained dust. In the cyclone chamber 70, air and dried vegetable dust are fed into a cyclone chamber 70 in a kinetic flow 104. The kinetic flow 104 of dust and air 102 speeds into the cyclone chamber 70 creating a spiral vortex, similar to a tornado. Air, having a significantly lesser density than the entrained dust allows the air to escape readily through a duct 78 at the center of the vortex. The kinetic flow 104 carries dust particles forward with kinetic energy. The dust particles follow the cylindrical interior of the chamber in the kinetic flow 104. Gravity draws dust particles downward and as the air flow has left the cyclone chamber 70 through the duct 78, the dust particles slow and drop falling downward into and infeed hopper 48 where the feed auger 40 mixes the dust with the moist vegetable material the auger 40 feeds into the interior of the drum 38.

Importantly, the moisture of the infed vegetable material 34 acts to coalesce the dry dust particles especially exploiting the mixing action of the infeed auger 40 upon the moist vegetable matter. In fact, the dust is folded into the vegetable material 34 which actually tends to prevent clumping by amalgamating this very dry dust into the interior of the flow of vegetable matter makes the vegetable matter very much more susceptible to be broken up by the air knife 26 at the base of the hopper 19 (See FIGS. 2, 3, 4, and 5 for the breaking up of vegetable material 34 into the aerosol of vegetable material 36. Interposition of dried material into the matrix that might make up a clump or ball degrades the structural strength of the clump or ball. Thus, minimal force is necessary to break up the clump or ball because of the interposition of this dried dust in the matrix preventing moist matter from clinging to moist matter.

Referring now again to FIGS. 9 and 10, the drying flow of air fed to plenum 14 is pressed through the furnace 96 with its internal heat exchanger by a furnace blower 98 which draws its air from the ambient atmosphere. Thus, the furnace blower 98 pressurizes the plenum 14 to drive air through the nozzle 20 (FIGS. 2 and 3 especially). The rotational speed of the furnace blower 98 can be selected to assure that the air knife 26 tears the stacked vegetable material 34*a* within the collision region 28. The stacked vegetable material 34*a* collides with the air knife 26 to achieve the three important functions discussed above: 1) to tear, because of the distinct velocities and directions of the flows of the stacked vegetable material 34*a* and the air knife 26 breaking up clumped stacked vegetable material 34*a* into its smallest particles; 2) bathing the now broken up clumped stacked vegetable material 34*a* with heated air drying the vegetable material more completely and quickly; and 3) accelerating stacked vegetable material 34*a* moving it rapidly out of the collision region 28 in an aerosol of vegetable material 36 making room for more stacked vegetable material 34*a* to collide with the air knife 26. Each of these three important functions enhances the drying efficiency of the rotary dryer. Any surplus of air within the rotary drum 38 can be drawn out by the exhaust blower 78. The pressure sensing vane 84 (FIG. 12B), discussed above, working in conjunction with the exhaust blower 78 and motor 56 and the controller (not shown) will equalize the pressure inside of the drum 38 to an optimal pressure and balance between the rotational speeds of the furnace blower 98 and the exhaust blower 78 and motor 56.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus for drying vegetable material, the apparatus comprising:

a cylindrical drum having a plurality of vanes extending radially into the drum and extending axially substantially the length of the drum, the drum driven, in operation, to rotate about its axis such that the plurality of vanes convey vegetable material from a lowest point in the interior of the drum to a highest point in the interior of the drum, there to drop the vegetable material downward within the interior of the drum;

a feed end structure defining:

an infeed port for admitting vegetable material into the interior of the drum; and an intake port for admitting a flow of heated air into a plenum extending substantially the length of drum;

a discharge end structure defining a discharge chute for removing dried vegetable material from the interior of the drum;

the plenum being in fluid communication with a nozzle, the nozzle opening in a rectangular slot extending in its longest dimension substantially the length of the drum, the plenum and nozzle being housed to form a Coandă-effect nozzle body having a tear-shaped housing, the housing comprising two Coandă surfaces situated in opposed relation and terminating at the nozzle, the Coandă surfaces to guide air to be entrained, in operation, with a jet of air issuing from the nozzle to form a combined flow; and a hopper plate which, in cooperation with one of the Coandă surfaces forms a hopper to collect, in operation, vegetable material falling from the plurality of vanes and to direct the fallen vegetable material to collide with the combined flow to dry the vegetable material such that combined flow moves the vegetable material to the lowest point in the interior of the drum.

2. The apparatus of claim 1, further comprising an infeed hopper terminating in and defining the infeed port and housing an infeed auger which motivates the vegetable material into the interior of the drum.

3. The apparatus of claim 1, the drum further comprising a plurality of rollers allowing the drum to rotate about its axis in operation.

4. The apparatus of claim 1, wherein the drum is driven into rotation by an electric motor.

5. The apparatus of claim 2, wherein an intake volume of heated air is driven into the plenum by an intake blower and wherein an exhaust volume of air and dust are drawn from the interior of the drum and wherein the intake volume is less than the exhaust volume.

6. The apparatus of claim 5, wherein the exhaust volume drawn from the interior of the drum through an exhaust port the feed end structure defines, the exhaust volume is directed into a cyclone separator such that the dust the exhaust volume contains is precipitated from the exhaust volume to fall into the infeed hopper.

7. The apparatus of claim 6 wherein the exhaust volume drawn from the interior of the drum is controlled in response to a position of a pressure sensing vane hingedly affixed within a pressure sending port, the pressure sensing vane configured to sense a pressure difference between a drum pressure within the interior of the drum and an ambient pressure.

8. The apparatus of claim 7, wherein the position of the pressure-sensing vane generates a vane signal and wherein the exhaust volume is regulated by means of a phase-locked loop based upon the vane signal.

9. An apparatus for drying vegetable material, the apparatus including:

a drum defining an interior, the drum in operation rotating about its axis in sealed rotatable engagement between;

a feed-end structure, the feed-end structure defining:

an infeed hopper defining an infeed port for admitting vegetable material into the drum, an exhaust port through which, in operation, an exhaust blower draws an exhaust volume of heated air and dust from the interior of the drum, and a plenum through which an intake blower blows an intake volume of heated air into the drum for drying vegetable material, the intake volume selected not to exceed the exhaust volume, the plenum being in fluid communication with a nozzle, the nozzle opening in a rectangular slot extending in its longest dimension substantially the length of the drum, the plenum and nozzle being housed to form a Coandă-effect nozzle body having a tear-shaped housing, the housing comprising two Coandă surfaces situated in opposed relation and terminating at the nozzle, the Coandă surfaces to guide air to be entrained, in operation, with a jet of air issuing from the nozzle to form a combined flow; and a discharge-end structure defining a discharge chute for removing vegetable material from the interior of the drum; and the exhaust blower connected to blow the exhaust volume of heated air and dust into a cyclone separator, the cyclone separator allowing the heated air to escape to the ambient and to drop dust into the infeed hopper to mix with vegetable material as the vegetable material is admitted into the drum.

10. The apparatus of claim 9 wherein the drum further comprises a plurality of vanes within the interior extending radially into the drum and extending axially substantially the length of the drum, the drum driven, in operation, to rotate about its axis such that the plurality of vanes convey vegetable material from a lowest point in the interior of the drum to a highest point in the interior of the drum, there to drop the vegetable material downward within the interior of the drum.

11. The apparatus of claim 9 further including a hopper plate which, in cooperation with one of the Coandă surfaces forms a hopper to collect, in operation, vegetable material falling from the plurality of vanes and to direct the fallen vegetable material to collide with the combined flow to dry the vegetable material such that combined flow moves the vegetable material to the lowest point in the interior of the drum.

12. The apparatus of claim 9 wherein the exhaust volume drawn from the interior of the drum through an exhaust port the feed end structure defines, the exhaust volume is directed into a cyclone separator such that the dust the exhaust volume contains is precipitated from the exhaust volume to fall into the infeed hopper.

13. The apparatus of claim 12 wherein the exhaust volume drawn from the interior of the drum is controlled in response to a position of a pressure sensing vane hingedly affixed within a pressure sending port, the pressure sensing vane configured to sense a pressure difference between a drum pressure within the interior of the drum and an ambient pressure.

14. The apparatus of claim 13, wherein a position of the pressure sensing vane is sensed to determine the difference between a pressure in the interior of the drum and the ambient pressure.

15. The apparatus of claim 14, wherein the position of the pressure sensing vane generates a vane signal and wherein the exhaust volume is regulated by means of a phase-locked loop based upon the vane signal.

16. A method for drying vegetable material comprising:

providing a drum defining an interior, wherein the drum further comprises a plurality of vanes within the interior extending radially into the drum, and extending axially substantially the length of the drum the drum driven, in operation, to rotate about its axis such that the plurality of vanes convey vegetable material from a lowest point in the interior of the drum to a highest point in the interior of the drum, there to drop the vegetable material from interspaces between the plurality of vanes downward within the interior of the drum situated in sealed rotatable engagement between;

a feed-end structure, the feed-end structure defining:

an infeed hopper defining an infeed port for admitting vegetable material into the drum, an exhaust port through which, in operation, an exhaust blower draws an exhaust volume of heated air and dust from the interior of the drum, and a plenum through which an intake blower blows an intake volume of heated air into the drum for drying vegetable material, the intake volume selected not to exceed the exhaust volume, the plenum being in fluid communication with a nozzle, the nozzle opening in a rectangular slot extending in its longest dimension substantially the length of the drum, the plenum and nozzle being housed to form a Coandă-effect nozzle body having a tear-shaped housing, the housing comprising two Coandă surfaces situated in opposed relation and terminating at the nozzle, the Coandă surfaces to guide air to be entrained, in operation, with a jet of air issuing from the nozzle to form a combined flow; and a discharge-end structure defining a discharge chute for removing vegetable material from the interior of the drum;

rotating the drum;

feeding vegetable material through the infeed hopper into the interior of the drum;

blowing an intake volume of heated air into the plenum to form an escaping jet of escaping air having a rectangular cross-section extending substantially the length of the drum, the escaping jet entraining air in the interior of the drum into a Coandă-effect combined airflow;

providing a hopper plate extending substantially the length of the drum, which in cooperation with the Coandă-effect nozzle body forms a hopper;

catching, in the hopper, vegetable material dropping downward from the interspaces between the vanes within the interior of the drum, the hopper directing the caught vegetable material into the Coandă-effect combined airflow, the Coandă-effect combined airflow combining with the vegetable material to form an aerosol.

17. The method of claim 16, further comprising:

drawing an exhaust volume of air and dust from the interior of the drum; the exhaust volume to exceed the intake volume;

directing the exhaust volume into a cyclone separator to generate a flow of air and to precipitate dust from the exhaust volume;

feeding the precipitated dust into the infeed hopper to mix with the vegetable material and enter the interior of the drum.

18. The method of claim 17 further comprising:

providing a pressure sensing port connecting the interior of the drum with the ambient atmosphere and a pressure-sensing vane hingedly affixed within the pressure sensing port such that a pressure difference between an interior pressure within the interior of the drum and an ambient pressure, the pressure-sensing vane being motivated into a vane position by a flow of air through the pressure-sensing port;

sensing the vane position to generate a vane position signal;

selecting the exhaust volume of heated air and dust into the cyclone separator, the selection being sufficient to motivate the pressure-sensing vane to assume a selected vane position.

19. The method of claim 18, further comprising;

employing the vane-position signal to control the exhaust volume by means of a phase-locked loop.

20. The method of claim 16, further comprising:

receiving dried vegetable material at the discharge chute to remove the dried vegetable material from the interior of the drum.

* * * * *